US007798584B2

(12) United States Patent
Markey

(10) Patent No.: US 7,798,584 B2
(45) Date of Patent: Sep. 21, 2010

(54) FLOATING MULLION

(75) Inventor: Ralph Markey, Columbus, NC (US)

(73) Assignee: Thermo Fisher Scientific Inc., Waltham, MA (US)

( * ) Notice: Subject to any disclaimer, the term of this patent is extended or adjusted under 35 U.S.C. 154(b) by 706 days.

(21) Appl. No.: 10/127,608

(22) Filed: Apr. 23, 2002

(65) Prior Publication Data

US 2003/0197454 A1 Oct. 23, 2003

(51) Int. Cl.
*A47B 96/04* (2006.01)

(52) U.S. Cl. ..... 312/405; 312/296

(58) Field of Classification Search ..... 312/407, 312/405, 321.5, 296, 291; 49/366–369
See application file for complete search history.

(56) References Cited

U.S. PATENT DOCUMENTS

| | | | | | |
|---|---|---|---|---|---|
| 1,051,617 | A | * | 1/1913 | Mulford | 49/367 |
| 1,340,506 | A | * | 5/1920 | Smithback et al. | 49/367 |
| 2,101,803 | A | * | 12/1937 | Ames | 49/368 |
| 2,130,617 | A | * | 9/1938 | Dockham | 312/291 |
| 2,301,020 | A | * | 11/1942 | Dailey | 312/291 |
| 2,302,385 | A | * | 11/1942 | Anderson | 62/446 |
| 2,386,919 | A | * | 10/1945 | Tobey | 62/442 |
| 2,575,094 | A | * | 11/1951 | Chamberlain | 49/368 |
| 2,723,896 | A | * | 11/1955 | Wurtz | 312/296 |
| 2,871,056 | A | * | 1/1959 | Levitt | 49/368 |
| 3,077,644 | A | * | 2/1963 | Kesling | 49/366 |
| 3,216,776 | A | * | 11/1965 | Carbary | 312/296 |
| 3,248,159 | A | * | 4/1966 | Hall | 312/296 |
| 3,264,048 | A | * | 8/1966 | Koch et al. | 312/296 |
| 3,362,108 | A | * | 1/1968 | Jones | 49/478.1 |
| 3,675,271 | A | * | 7/1972 | Fellwock et al. | 16/265 |
| 3,678,627 | A | * | 7/1972 | Dixon | 49/368 |
| 4,288,135 | A | * | 9/1981 | Buchser et al. | 312/296 |
| 4,651,959 | A | * | 3/1987 | Bolton et al. | 248/208 |
| 4,690,468 | A | * | 9/1987 | Lau | 312/291 |
| 4,735,062 | A | * | 4/1988 | Woolley et al. | 62/277 |
| 4,818,043 | A | * | 4/1989 | Borgen | 312/296 |
| 4,955,675 | A | * | 9/1990 | Donaghy | 312/405 |
| 5,216,840 | A | * | 6/1993 | Andrews | 49/368 |
| 5,269,099 | A | * | 12/1993 | Kennedy et al. | 49/484.1 |
| 5,309,680 | A | * | 5/1994 | Kiel | 49/478.1 |
| 5,419,628 | A | * | 5/1995 | Myslinski et al. | 312/263 |
| 5,451,075 | A | * | 9/1995 | Parker et al. | 280/728.3 |
| 5,530,992 | A | * | 7/1996 | Baermann | 16/231 |
| 5,666,764 | A | * | 9/1997 | Beatty et al. | 49/397 |
| 5,870,801 | A | * | 2/1999 | Kim | 16/382 |
| 5,884,366 | A | * | 3/1999 | Jeong | 16/271 |

(Continued)

FOREIGN PATENT DOCUMENTS

| | | | | |
|---|---|---|---|---|
| FR | 2686644 | * | 7/1993 | 49/367 |

(Continued)

*Primary Examiner*—Hanh V Tran
(74) *Attorney, Agent, or Firm*—Wood, Herron & Evans, LLP

(57) ABSTRACT

A floating mullion that includes a bracket which is designed to be used when two interior doors are used to close off a desired chamber from ambient. The bracket is specially designed to close off the natural gap between the doors. This bracket will allow the opening and sealing of the inner doors without the need for a fixed mullion. The bracket is not limited to sealing two door chambers but may be used on multiple chambers as well.

13 Claims, 2 Drawing Sheets

U.S. PATENT DOCUMENTS 5,943,824 A * 8/1999 Tatara ..... 49/462
5,960,518 A * 10/1999 Jeong ..... 16/270
6,070,300 A * 6/2000 Shin et al. ..... 16/382
6,158,171 A * 12/2000 Kellogg et al. ..... 49/489.1
6,286,917 B1 * 9/2001 Strong ..... 312/326

FOREIGN PATENT DOCUMENTS

JP 05316612 * 11/1993 ..... 49/367

* cited by examiner

FLOATING MULLION

FIELD OF THE INVENTION

The present invention relates generally to refrigerated cabinet construction. More particularly, the present invention relates to a floating mullion for adjacent doors within a refrigerated cabinet.

BACKGROUND OF THE INVENTION

Presently, a fixed mullion is the only available method of providing a stop and a seal for adjacent doors in a refrigeration system. With a fixed mullion, the end user's storage space is limited and the loading and unloading of products is hampered.

For instance, in a conventional side-by-side refrigerator, freezer and fresh food compartment doors align along a vertically extending divider wall or mullion, with the mullion extending in a single plane essentially from the top to the bottom of the refrigerator. Although this style of refrigerator has certain advantages over top-mount refrigerators wherein the freezer compartment is arranged vertically above the fresh food compartment, certain disadvantages are also presented. For instance, since the opening provided in a household kitchen for both side-by-side and top-mount refrigerators is essentially standard, top-mount style refrigerators typically have wider shelves in each of the fresh food and freezer compartments as compared to the corresponding shelves in a side-by-side refrigerator.

For this reason, it is often difficult, if not impossible, to accommodate rather wide food items, such as trays, cake pans, platters, turkeys and the like, on a given shelf in the fresh food compartment of a side-by-side refrigerator, while the same item(s) could be readily placed on a corresponding shelf in a top-mount refrigerator. The same is true with respect to the width of the different freezer shelves. For example, it is often difficult to store frozen pizzas and other large food items widthwise in a side-by-side refrigerator freezer compartment, while such items can be easily arranged in the freezer compartment of a top-mount refrigerator. To compensate for this disadvantage, it is not uncommon for owners of side-by-side refrigerators to purchase a second refrigerator for additional food storage space.

In the construction of a refrigerator cabinet, it is typical to include a metal mullion bar positioned between side walls of a horizontally disposed freezer and fresh food compartment or between the top and bottom walls of side-by-side freezer and fresh food compartments. The purpose of the mullion bar or rail is well known to provide support between the side walls of the refrigerator and to provide a load bearing structure about which the liners of the freezer and fresh food compartment are constructed.

The mullion rails or bars are located across the open front of the refrigerator cabinet exposed to the ambient atmosphere and at least a portion of the interior liner of the freezer compartment and/or the fresh food compartment. Typically, the mullion bar provides a structural support to which a partition for the freezer and fresh food compartments are constructed. Since the mullion bar is a metallic material, the mullion is a good heat transfer medium between the ambient atmosphere and the freezer compartment and/or the fresh food compartment. When the ambient air is humid, condensation appears on the face of the mullion bar. To prevent sweating the mullion bar has heater which warms the mullion surface exposed to the ambient air. However these heaters also heat the fresh food compartment and/or freezer compartment raising the energy requirements needed to maintain operation of the refrigerator.

The mullion bar also provides a reinforced surface against which the doors may close. The door includes a gasket having magnets which are attracted to the metal mullion bar to effect a seal against the mullion bar. Thus the mullion bar is required to provide an effective seal against the door gaskets which must withstand the stresses of repeated door closure and provide a magnetic attracting medium.

Present manufacturers of ultra low temperature refrigerated equipment utilize interior access doors to help with temperature control and reduce the migration of cold air out of the unit. The problem that exists with interior access doors is that with extended lengths, manufacturers are faced with structural and thermal concerns. A longer door gives a moment arm, which can deform or crack hinge surfaces over time. Along with these structural issues there is also the thermal movement of the door. Thermal movement is due to the coefficient of linear expansion. The growth/shrink of the interior access door is proportional to its length, change in temperature and selection of material used.

For example, a typical response of a 39 inch long inner access door manufactured from ABS plastic will have thermal movement relative to the following formula:

$$\text{Change in Length(in.)} = \text{Length at Ambient(in.)} \times \text{Coeff. of Expansion} \times 10^{-6} \times \text{Change in Temp (° F.)}$$

For example, $$\text{Change in Length(in.)} = 39 \times 53 \times 10^{-6} \times 200.8° \text{ F.}$$

$$\text{Change in Length(in.)} = 0.41505$$

Presently, manufacturers either limit the inner access door length or utilize a fixed mullion to divide the required length by two. The use of a fixed mullion will limit accessibility while adding considerable cost to both the consumer and the manufacturer.

A need therefore exists for a refrigerator that will allow full access to larger chambers without affecting interior temperature or damaging the interior by deformations.

SUMMARY OF THE INVENTION

It is therefore a feature and advantage of the present invention to provide a bracket that is designed to be used when at least two interior doors are used to close off a desired chamber from the ambient atmosphere. The bracket is specially designed to close off the natural gap between the doors. This bracket will allow the opening and sealing of the inner access doors without the need for a fixed mullion. The bracket is not limited to sealing two door chambers but may be used on multiple chambers as well.

It is another feature and advantage of the present invention to provide a stop and a seal for adjacent doors.

The above and other features and advantages are achieved through the use of a novel floating mullion as herein disclosed. In accordance with one embodiment of the present invention, the floating mullion includes a bracket connected to an inside surface of an interior access door. The bracket can be fixedly attached to the door by pop rivets or the like. A seal is made between the interior access door and an adjacent interior access door by a magnet. The bracket can be made from a magnetic material to which the magnetic seal is attracted. The bracket has a generally Z-shaped cross sectional configuration in order to span between the doors and the to create a stop for the other interior door.

In accordance with another embodiment of the present invention, the method of making a floating mullion includes configuring a generally Z-shaped bracket along a cross sectional area and mounting the bracket to an interior access door. A sealing pack can be mounted on an adjacent interior access door and the Z-shaped bracket overlaps and spans between both interior access doors. The sealing pack is flush with the bracket when both doors are in the closed position, thus creating the seal. The sealing pack can be a magnet and the bracket may be a magnetic material, preferably stainless steel.

In accordance with another embodiment of the present invention, a refrigeration system including an outer door connected to a cabinet wall which surrounds a chamber on five sides. This refrigeration system further includes two interior access doors with one door have a floating mullion and an adjacent door having a sealing pack. The sealing pack may be a magnet. The floating mullion can be fixedly mounted to one interior access door by pop rivets or the like.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF A PREFERRED EMBODIMENT OF THE INVENTION

The present invention provides a floating mullion 18 bracket that is designed to be used when two interior access doors 14 are used to close off a desired chamber 19 from ambient air. The floating mullion 18 bracket is specially designed to close off the natural gap 17 between the interior access doors 14 and has a generally Z-shaped cross section. This floating mullion 18 bracket will allow the opening and sealing of the interior access doors 14 without the need for a fixed mullion. The floating mullion 18 bracket is not limited to sealing two door chambers but may be used on multiple chambers as well (not shown).

Figures 1, 2:
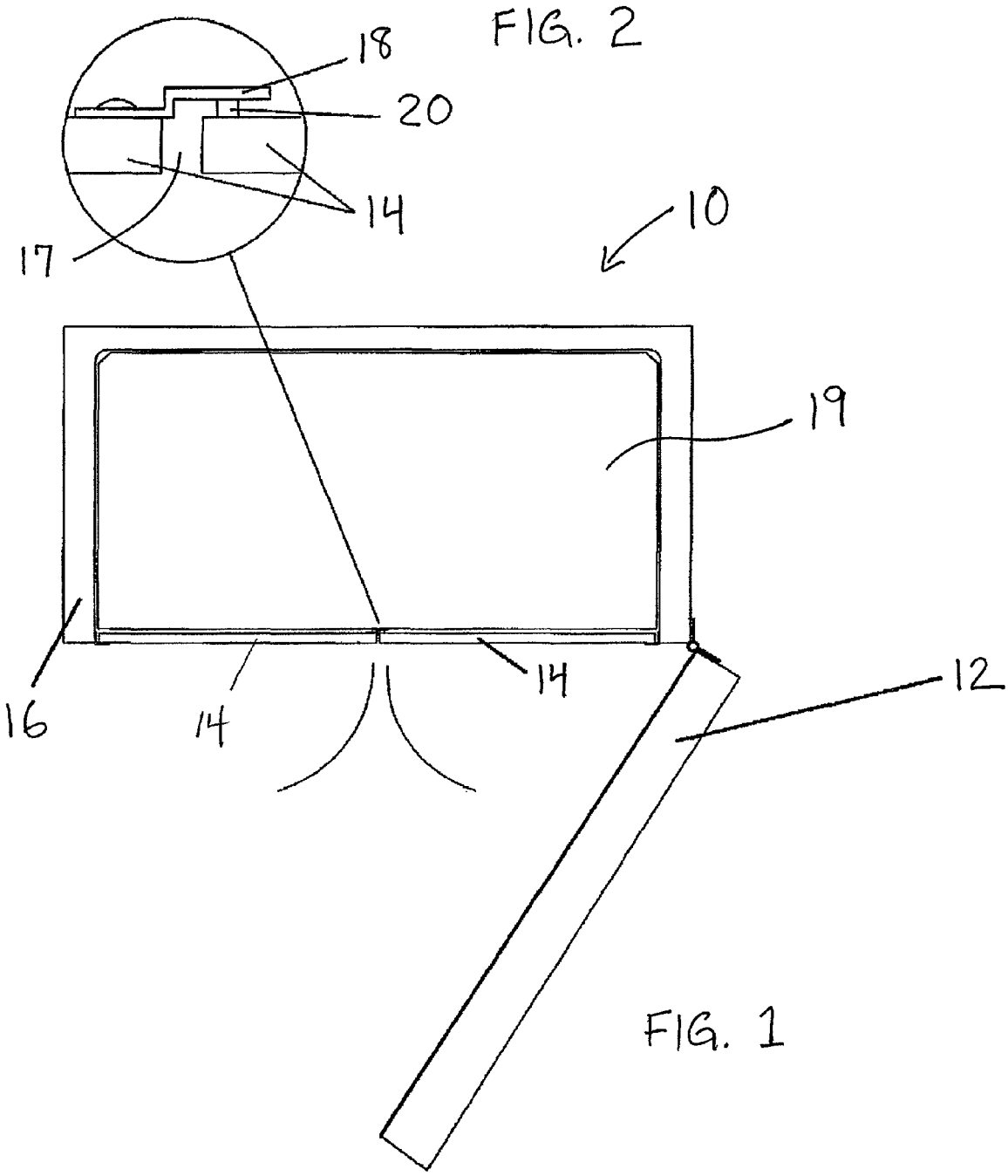
FIG. 1 provides a top cross sectional view of a refrigeration cabinet illustrating several elements of a preferred embodiment of the present invention.
FIG. 2 provides a plan view of the left-oriented floating mullion in a preferred embodiment of the present invention.

A preferred embodiment of the present inventive apparatus and method is illustrated in FIG. 1. In FIG. 1 a refrigeration cabinet 10 including an outer door 12, at least two interior access doors 14, a chamber 19, and an outer wall 16 is shown. Interior access doors 14 are designed to swing open outwardly from the refrigeration cabinet 10 in order to easily access the interior contents as needed. Interior access doors 14 inherently have a small gap 17 therebetween as shown in FIG. 2. Conventional interior access doors require a fixed mullion (not shown) in order to prevent any ambient temperature losses from occurring via gap 17.

Referring to FIG. 2, a preferred embodiment of the present invention is a left-oriented floating mullion 18 bracket attached to one of the interior access doors 14 by a bolt 15 or other connecting means, e.g., aluminum pop rivets, on an inner surface of interior access doors 14. The floating mullion 18 further is comprised of a magnetic material, e.g., 430 stainless steel. The other of interior access doors 14 includes a magnet pack 20 mounted on an interior surface of the other of interior access doors 14 in order to provide a means of sealing the interior access doors 14 when in a closed position (FIGS. 2 & 3).

Figure 3:
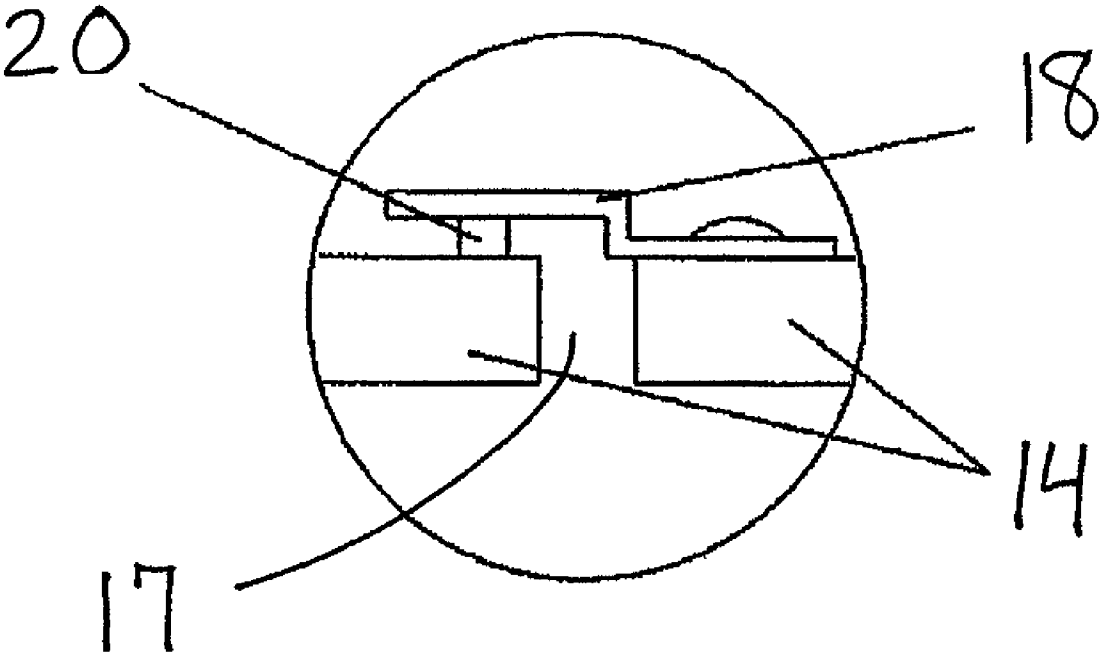
FIG. 3 provides a plan view of the right-oriented floating mullion in a preferred embodiment of the present invention.

Referring to FIG. 3, the orientation of the floating mullion 18 bracket may be changed to right-oriented based on a user's needs. This configuration provides the flexibility for right-handed users to easily use the refrigeration cabinet 10 without feeling awkward when opening the interior access doors 14.

The floating mullion 18 bracket acts as a thermal barrier for gap 17 and replaces the conventional fixed mullion (not shown). The design of a floating mullion 18 bracket results in a more accessible interior compartment 19. The use of a conventional fixed mullion would obviously limit the access to the chamber 19 by separating the interior access doors 14 in a fixed manner with a dividing fixed mullion (not shown). The present invention overcomes this limitation by having a floating mullion 18 bracket fixedly attached to the interior access doors 14 on either the left or right side (FIGS. 2 & 3). This eliminates the need of the fixed mullion configuration.

Furthermore, the floating mullion 18 bracket provides both a stop and a seal for the interior access doors 14.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A floating mullion, comprising:

a bracket mounted to an inner door of a refrigeration device, wherein said bracket being generally Z-shaped along a cross-sectional area and having a first leg and a second leg wherein the inner door comprises:

a first free swinging edge configured to swing in an arc having an approximate radius of about a length of the inner door;

an inside face of the inner door facing an inner compartment of the refrigeration device;

wherein the first leg of the bracket is mounted on the inside face of the inner door and adjacent to the first free swinging edge; and a sealing pack connected to an adjacent door, wherein the adjacent door comprises:

a second free swinging edge configured to swing in an arc having an approximate radius of about a length of the adjacent door, an inside face of the adjacent door facing the inner compartment of the refrigeration device;

wherein the sealing pack is connected on the inside face of the adjacent door and adjacent to the second free swinging edge so as to project inwardly toward the inner compartment when the second free swinging edge is facing the first free swinging edge, such that said sealing pack is flush with the second leg of the bracket when both the inner door and the adjacent door are in a closed position; and further wherein the inner and adjacent doors are interior access doors of the refrigeration device, and the refrigeration devices further includes an exterior access door.

2. The floating mullion of claim 1, wherein said bracket is a magnetic material.

3. The floating mullion of claim 2, wherein said magnetic material is stainless steel.

4. The floating mullion of claim 1, wherein a connector fixedly attaches said bracket to said inner door, and said connector comprises a plurality of pop rivets.

5. The floating mullion of claim 1, wherein the inner door is located on the left side of the refrigeration device.

6. The floating mullion of claim 1, wherein the inner door is located on the right side of the refrigeration device.

7. The floating mullion of claim 1, wherein said bracket acts as a stop for the adjacent door.

8. The floating mullion of claim 1, wherein a connector fixedly attaches said bracket to said inner door, and said connector comprises a plurality of bolts.

9. A floating mullion, comprising:

a generally Z-shaped bracket having a first leg and a second leg;

means for mounting said bracket to an access door of a refrigeration device, wherein the access door comprises:

a first free swinging edge configured to swing freely in an arc;

an inside face of the access door facing an inner compartment of the refrigeration device;

wherein the first leg of the bracket is mounted to the inside face of the access door and adjacent to the first free swinging edge; and means for sealing an adjacent access door, wherein the adjacent access door comprises:

a second free swinging edge configured to swing freely in an arc;

an inside face of the adjacent door facing an inner compartment of the refrigeration device;

wherein the means for sealing is connected to the inside face of the adjacent door and adjacent to the second free swinging edge so as to project inwardly toward the inner compartment when the second free swinging edge is facing the first free swinging edge;

wherein said means for sealing is flush with the second leg said bracket when both said access door and said adjacent access door are in a closed position said access door and adjacent door are interior access doors of the refrigeration device, and the refrigeration devices further includes an exterior access door.

10. The floating mullion of claim 9, wherein said means for sealing is a magnet.

11. The floating mullion of claim 9, wherein said bracket is a magnetic material.

12. The floating mullion of claim 11, wherein said bracket is stainless steel.

13. The floating mullion of claim 9, wherein said means for mounting is a plurality of pop rivets.

* * * * *

UNITED STATES PATENT AND TRADEMARK OFFICE

CERTIFICATE OF CORRECTION

PATENT NO. : 7,798,584 B2
APPLICATION NO. : 10/127608
DATED : September 21, 2010
INVENTOR(S) : Ralph Markey It is certified that error appears in the above-identified patent and that said Letters Patent is hereby corrected as shown below:

Column 1, Line 66, reads “bar has heater which” and should read -- bar has a heater which --.

Column 2, Lines 66-67, reads “between the doors and the to create a stop for” and should read -- between the doors and create a stop for --.

Column 3, Lines 12-15, reads “In accordance with another embodiment of the present invention, a refrigeration system including an outer door connected to a cabinet wall which surrounds a chamber on five sides.” and should read -- In accordance with another embodiment of the present inventive apparatus, a refrigeration system includes an outer door connected to a cabinet wall which surrounds a chamber on five sides. --.

Column 4, Line 47, reads “spirits and scope of the invention” and should read -- spirit and scope of the invention --.

Column 5, Line 17, Claim 1, reads “devices further includes an” and should read -- device further includes an --.

Column 6, Lines 21-22, Claim 9, reads “with the second leg said bracket” and should read -- with the second leg of said bracket --.

Column 6, Line 23, Claim 9, reads “in a closed position said access door” and should read -- in a closed position, said access door --.

Column 6, Lines 25-26, Claim 9, reads “devices further includes an” and should read -- device further includes an --.

Signed and Sealed this
Eighth Day of February, 2011

David J. Kappos

David J. Kappos
*Director of the United States Patent and Trademark Office*